US006785970B1

(12) United States Patent
Zerlin

(10) Patent No.: US 6,785,970 B1
(45) Date of Patent: Sep. 7, 2004

(54) ELECTRICAL CUTTING UTENSIL

(76) Inventor: Elizabeth Zerlin, 4860 NW. 95th Dr., Coral Springs, FL (US) 33076

( * ) Notice: Subject to any disclaimer, the term of this patent is extended or adjusted under 35 U.S.C. 154(b) by 0 days.

(21) Appl. No.: 10/409,863

(22) Filed: Apr. 9, 2003

(51) Int. Cl.[7] ..... B26B 5/00; B26B 15/00; B26B 27/00

(52) U.S. Cl. ..... 30/277.4; 30/342; 30/337; 30/279.2; 30/303; 30/296.1; 30/DIG. 1; 30/122

(58) Field of Search ..... 30/342, 337, 279.2, 30/329, 299, 303, 304, 277.4, 136, 136.5, 296.1, DIG. 1, 164.9, 122

(56) References Cited

U.S. PATENT DOCUMENTS 1,020,865 A * 3/1912 Wieber ..... 30/114
3,183,538 A * 5/1965 Hubner ..... 15/22.1
4,891,884 A * 1/1990 Torbet ..... 30/277.4
5,058,273 A * 10/1991 Streger ..... 30/164.9
6,434,836 B1 * 8/2002 Olivares ..... 30/277.4

* cited by examiner

*Primary Examiner*—Boyer D. Ashley
(74) *Attorney, Agent, or Firm*—Mark D. Bowen, Esq.; Stearns Weaver Miller Weissler Alhadeff & Sitterson, P.A.

(57) ABSTRACT

An electric cutting utensil adapted to receive a variety of shaped attachments for cutting any of a variety of foods into fanciful shapes is disclosed. The cutting utensil includes a housing having an ergonomically designed external shape adapted to comfortably fit in a user's hand. The housing contains an electric motor having an output shaft connected to an attachment-receiving tip by an oscillation-generating coupling. The attachment-receiving tip includes a chuck lock assembly for receiving a plurality of variously sized and shaped interchangeable cutting heads. Each cutting head includes a projecting knife-like edge formed into a fanciful shape, such as a heart or a star, or any other suitable shape. The electric motor may be powered by one or more batteries contained within the housing, or by direct connection to an electrical outlet using a power cord. A base is provided for storage of the device and attachments. In the case of the battery powered embodiment the base is further adapted for re-charging.

10 Claims, 21 Drawing Sheets

ELECTRICAL CUTTING UTENSIL

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights.

BACKGROUND OF THE INVENTION

1. Field of the Invention

The present invention relates generally to kitchen utensils for use in the preparation of food, and, more particularly, to an electric hand-held cutting utensil adapted for cutting soft foods, such as batter and dough, pizza, pancakes, waffles, and quiches, into fanciful shapes.

2. Description of the Background Art

Humans have employed tools as useful instruments for cooking for countless centuries. As a result, a wide variety tools are known in the cooking art. For example, the use of knives, forks, spoons, and a host of other instruments and gadgets are known to render the cooking process efficient and sanitary. In addition, a wide variety of specially adapted utensils have been developed for specific tasks.

As a result of the advent of electricity, a number of electrically powered cooking instruments have been developed. For example, electric knives specifically designed for carving large servings of meat and poultry, and handheld mixing devices and food processors, are popular kitchen utensils in widespread use.

The wide variety of foods prepared by diverse populations have fueled the. development of specialized cooking utensils. For example, cookie cutters have been developed to facilitate the cutting of dough into fanciful shapes thereby enhancing presentation and appearance. There thus exists a need for an improved cooking utensil specifically designed and adapted for use in efficiently cutting foods into fanciful shapes with minimal time and effort.

BRIEF SUMMARY OF THE INVENTION

The present invention provides a hand-held electric cutting utensil adapted to receive a variety of shaped attachments adapted for cutting any of a variety of foods into fanciful shapes. The cutting utensil includes a housing having an ergonomically designed external shape adapted to comfortably fit in a user's hand. The housing contains an electric motor having an output shaft connected to an attachment-receiving tip by an oscillation-generating coupling. The attachment-receiving tip includes a chuck lock assembly for receiving a plurality of variously sized and shaped interchangeable cutting heads. Each cutting head includes a projecting knife-like edge formed into a fanciful shape, such as a heart or a star, or any other suitable shape. The electric motor may be powered by one or more batteries contained within the housing, or by direct connection to an electrical outlet using a power cord. A base is provided for storage of the device and attachments. In the case of the battery powered embodiment the base is further adapted for recharging.

Accordingly, it is an object of the present invention to provide an improved electric cutting utensil for use in preparing foods.

Another object of the present invention is to provide a hand-held cutting utensil adapted to interchangeably receive a plurality of cutting heads.

In accordance with these and other objects, which will become apparent hereinafter, the instant invention will now be described with particular reference to the accompanying drawings.

DETAILED DESCRIPTION OF THE INVENTION

With reference now to the drawings FIGS. 1–21 depict a preferred embodiment of a hand-held electric cutting utensil, generally referenced as 10, according to the present invention. In a preferred embodiment, hand-held electric cutting utensil 10 is adapted to receive a variety of shaped attachments, referenced as 20, adapted for cutting any of a variety of foods into fanciful shapes. Cutting utensil 10 includes a housing 12 having an ergonomic external shape formed to comfortably fit in a user's hand. Housing 12 defines and internal chamber, and may be fabricated from plastic, or any other suitable material. In addition, housing 12 has generally rounded edges for comfort and varies in overall thickness so as to fit in the palm of a user's hand. Housing 12 further includes a user-actuated switch 14, disposed on the upper surface thereof to control operation. Switch 14 is preferably a two-position sliding switch (e.g. on/off), however, in embodiments wherein cutting utensil 10 is capable of multiple speed operation, switch 14 will be multi-positional. In an embodiment that is powered by 120 VAC a power cord 16 is provided for connection to an electrical outlet.

Figure 1:
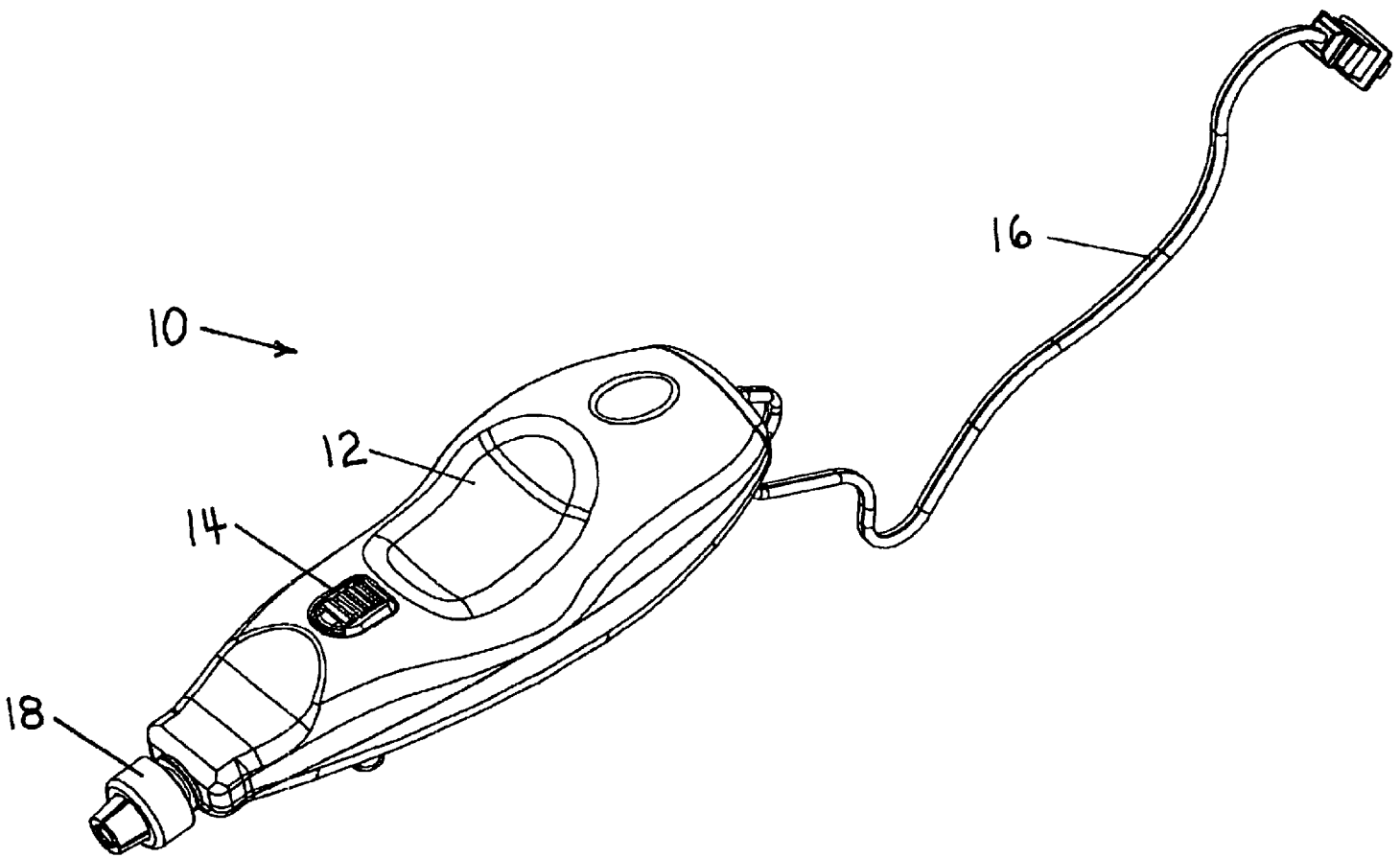
FIGS. 1–3 are top perspective views of a hand-held cutting utensil according to the present invention.
Figure 2:
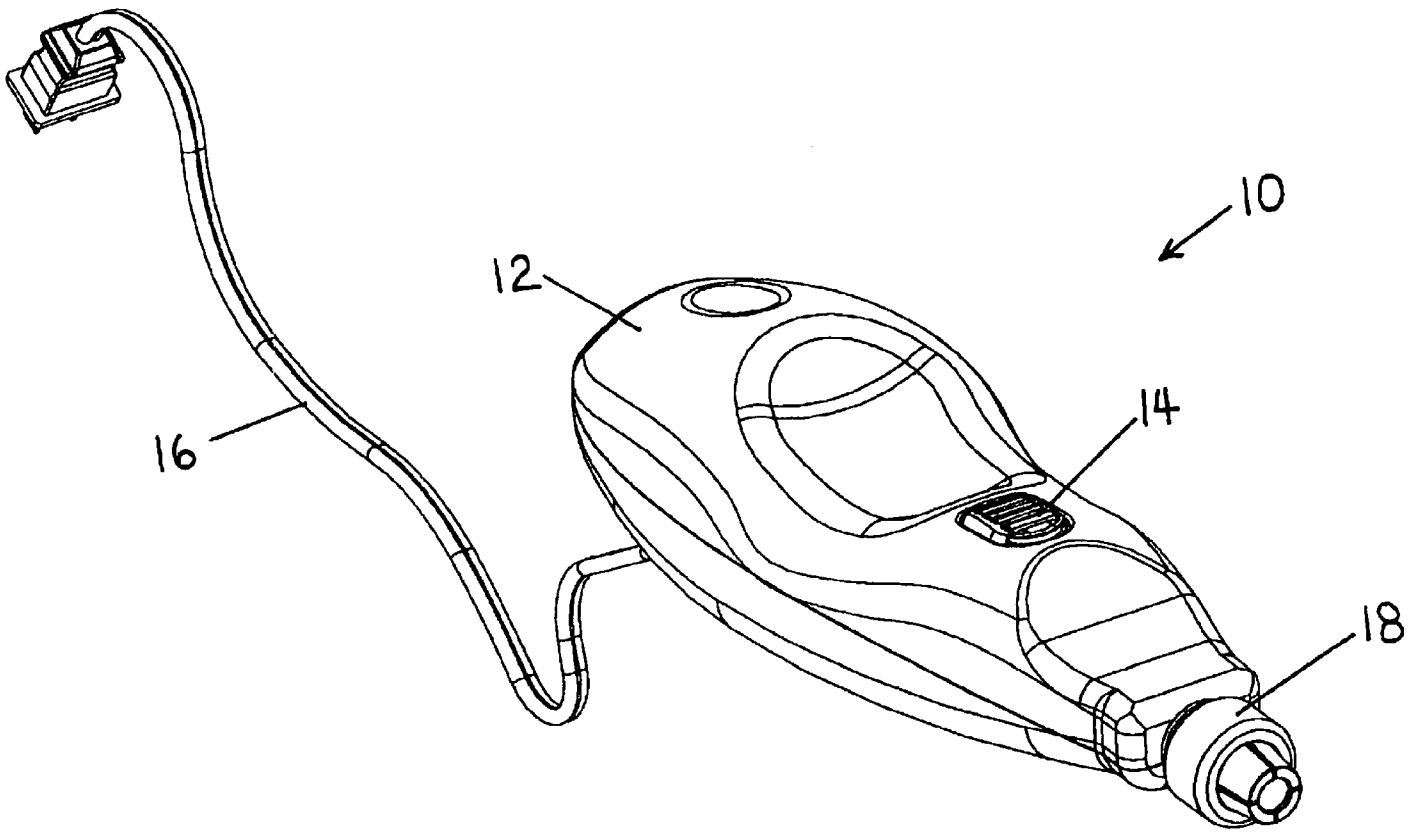
Figure 3:
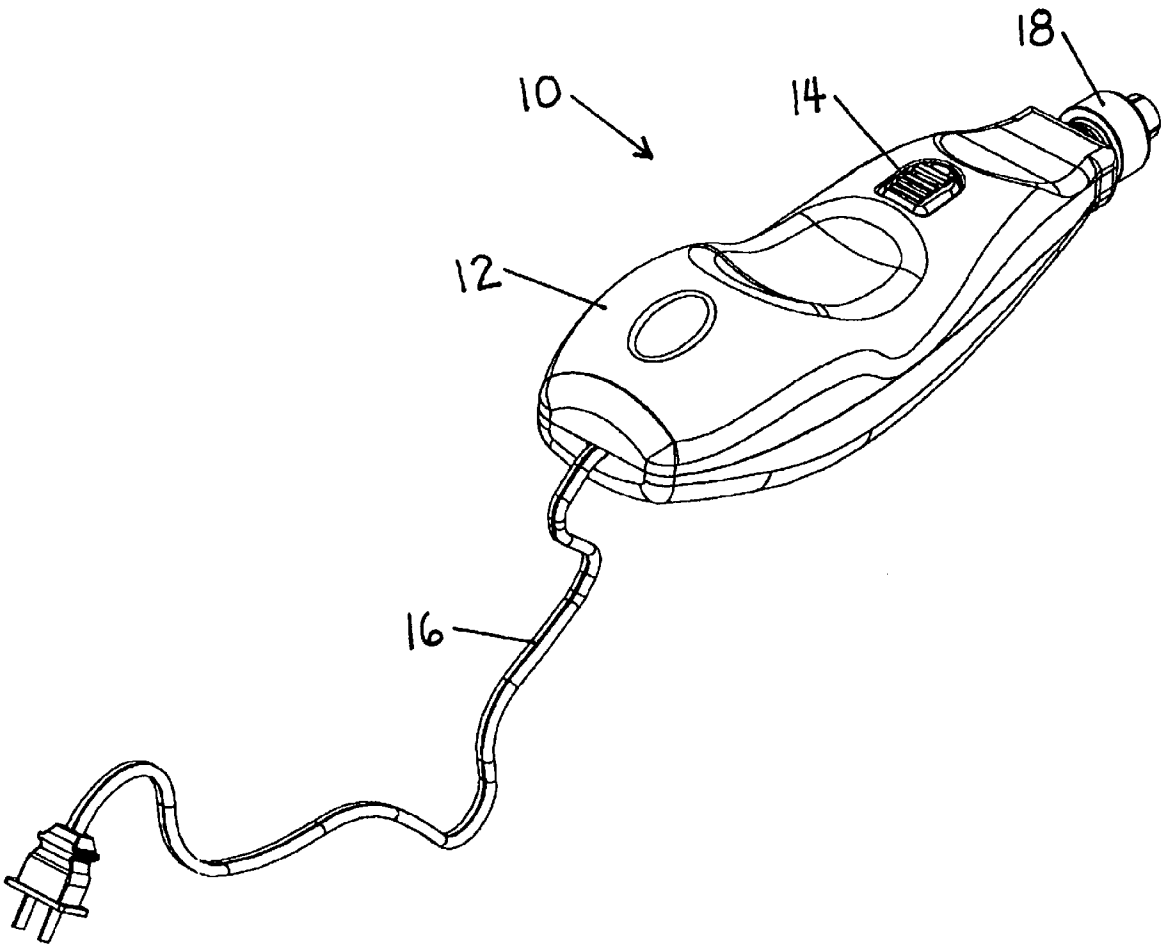
Figure 4:
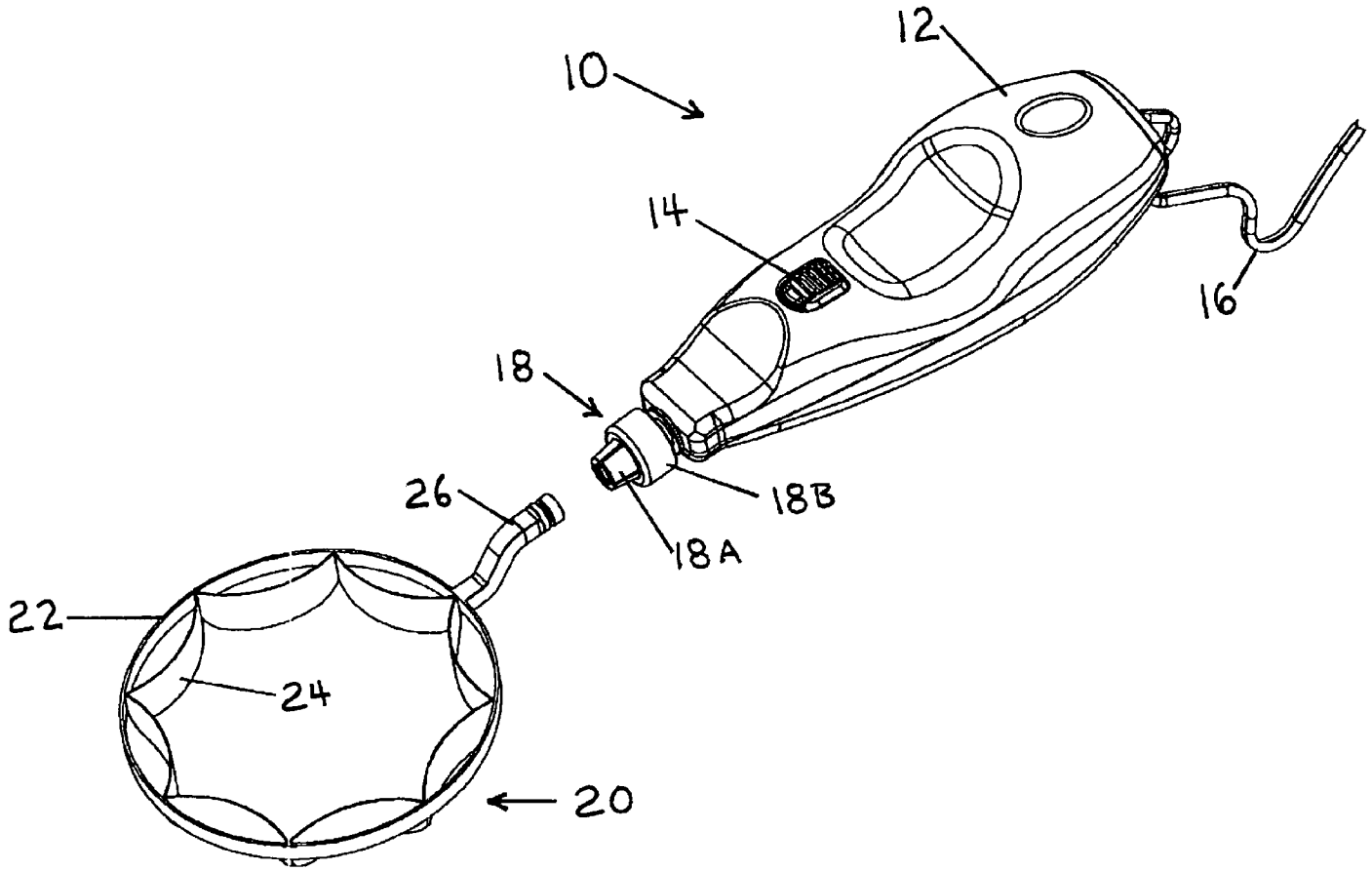
FIGS. 4–5 are exploded perspective views depicting the cutting utensil relative to an interchangeable head.
Figure 5:
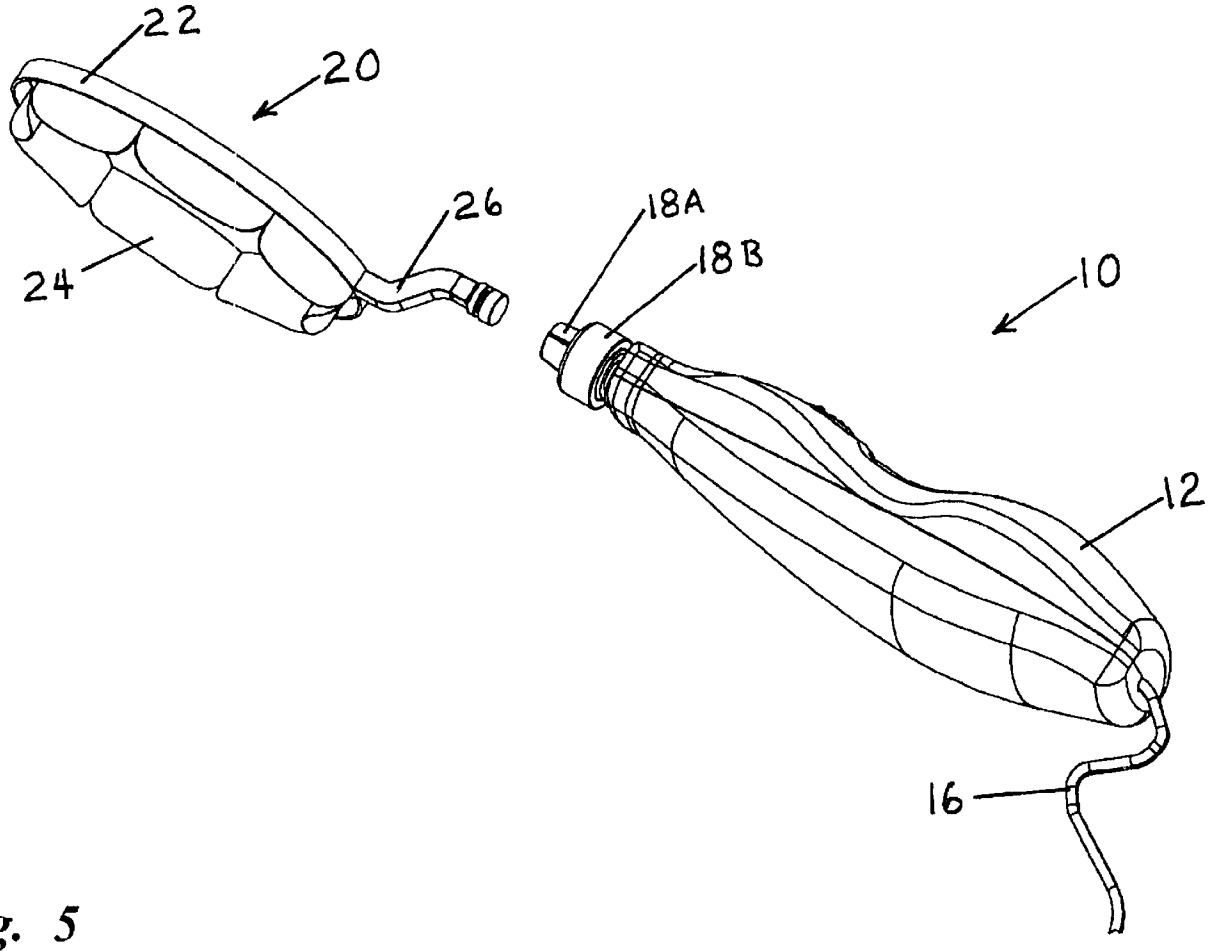
Figure 6:
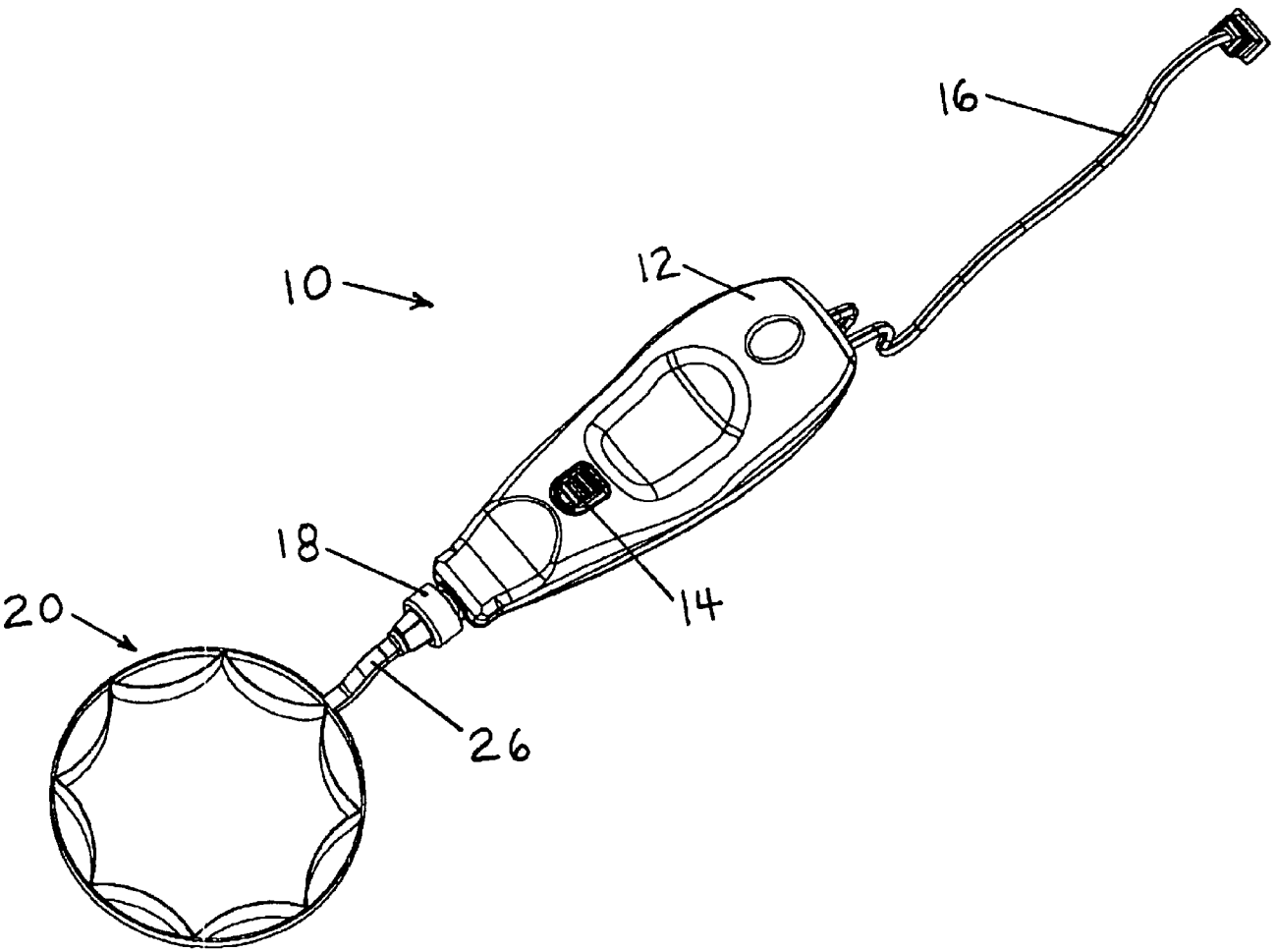
FIG. 6 is a top perspective view thereof with the head attached.

As best depicted in FIGS. 4–6, housing 12 further includes an end portion defining an opening, and a shaft 17 having a tip thereof, generally referenced as 18, projecting therefrom. Shaft tip 18 is adapted to receive any one of a plurality of interchangeable cutting heads, generally referenced as 20. Each cutting head 20 includes an annular support ring 22, a shaped cutting member 24 connected to annular support ring 22, and a mounting stem 26 connected to annular support ring 22 and projecting radially outward therefrom. Support ring 22, cutting member 24, and stem 26, are preferably fabricated from stainless steel, however, any suitable material is considered within the scope of the present invention. Annular support ring 22 provides a structural mount for supporting cutting member 24. Cutting member 24 includes a shaped, generally sharp, knife-like edge projecting from annular support ring 22 to facilitate cutting of the food product. Mounting stem 26 projects radially outward from support ring 22 and is preferably offset in a direction opposite of the knife-like edge of cutting member 24 to facilitate engagement of cutting member 24 with the food product when operatively attached to cutting utensil 10.

Figure 10:
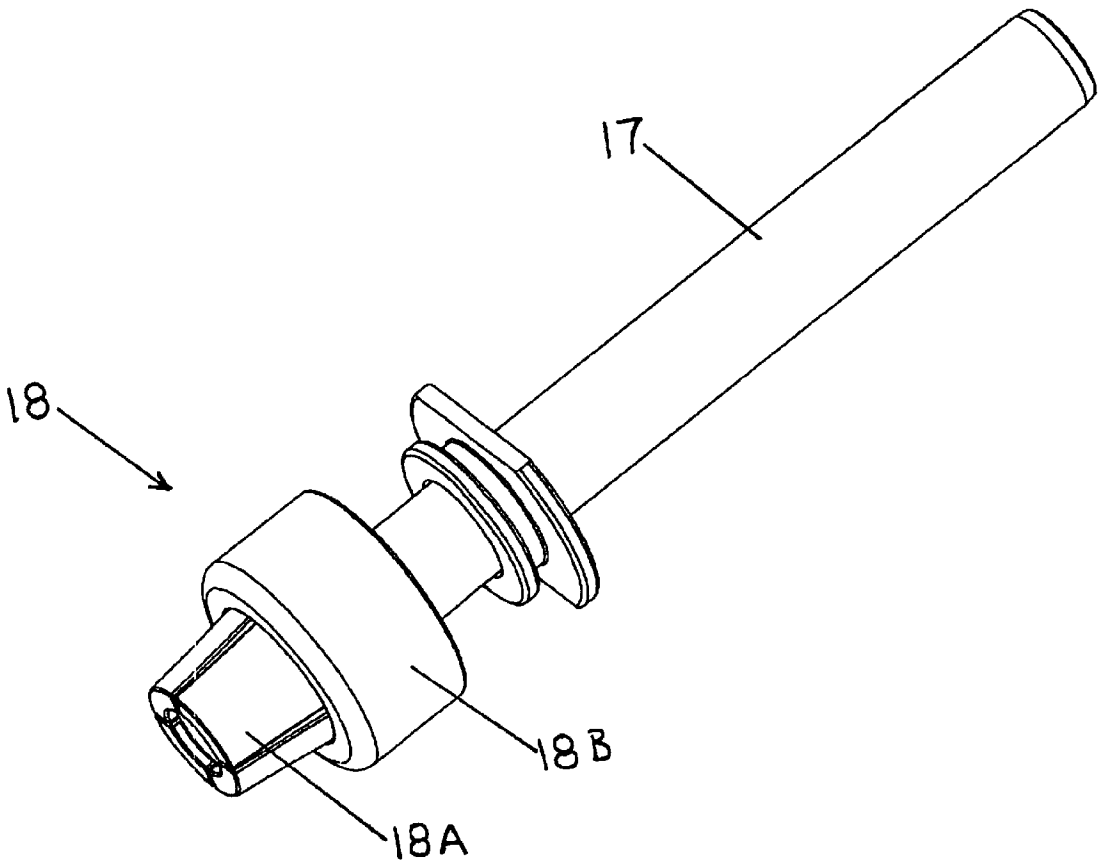
FIGS. 10–11 are perspective views of the shaft and attachment-receiving tip.
Figure 11:
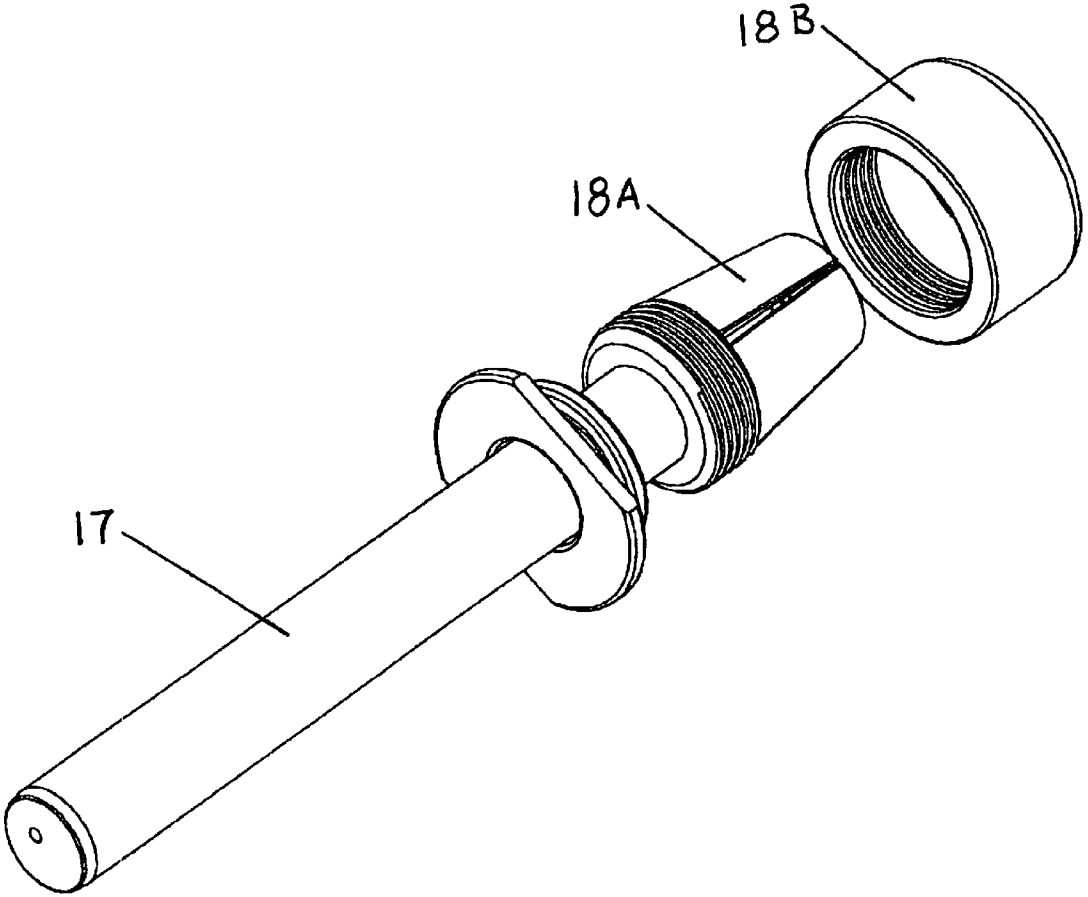
Figure 12:
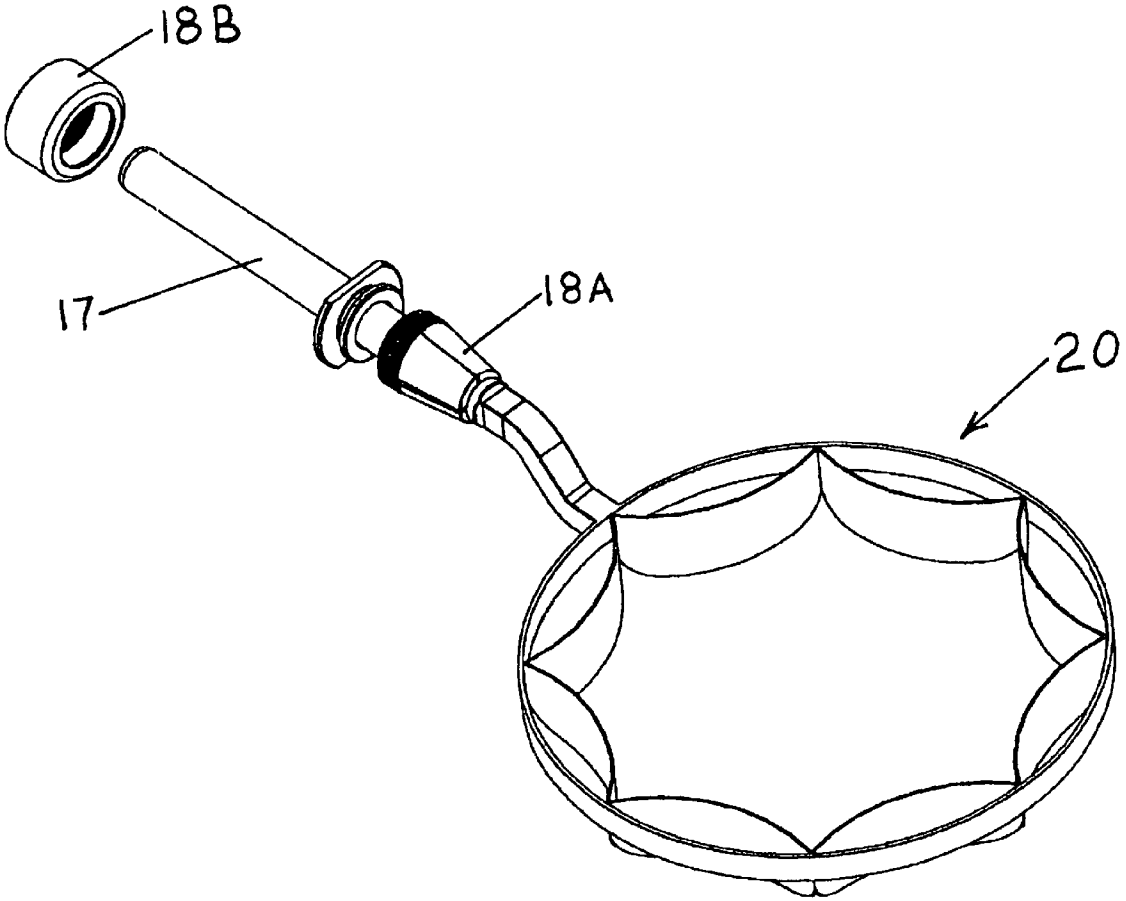
FIG. 12 illustrates attachment of a cutting head to the shaft tip.

As further depicted in FIGS. 10 and 11, shaft 17, and particularly tip 18 is adapted with a chuck lock assembly wherein a female connector is formed by a plurality of axially projecting members 18A and rotatable locking nut 18B. A cutting head is attached to cutting utensil 10 by inserted engagement of mounting stem 26 within tip 18 such that axially projecting members 18A are in surrounding relation therewith, and secured by rotation of locking nut 18B whereby axially projecting members are urged to a radially reduced configuration in engagement with mounting stem 26. As should be apparent, cutting head may be interchanged by loosening locking nut 18B, removing the previously installed cutting head, and installing an alternate cutting head by insertion of stem 26.

Figure 7:
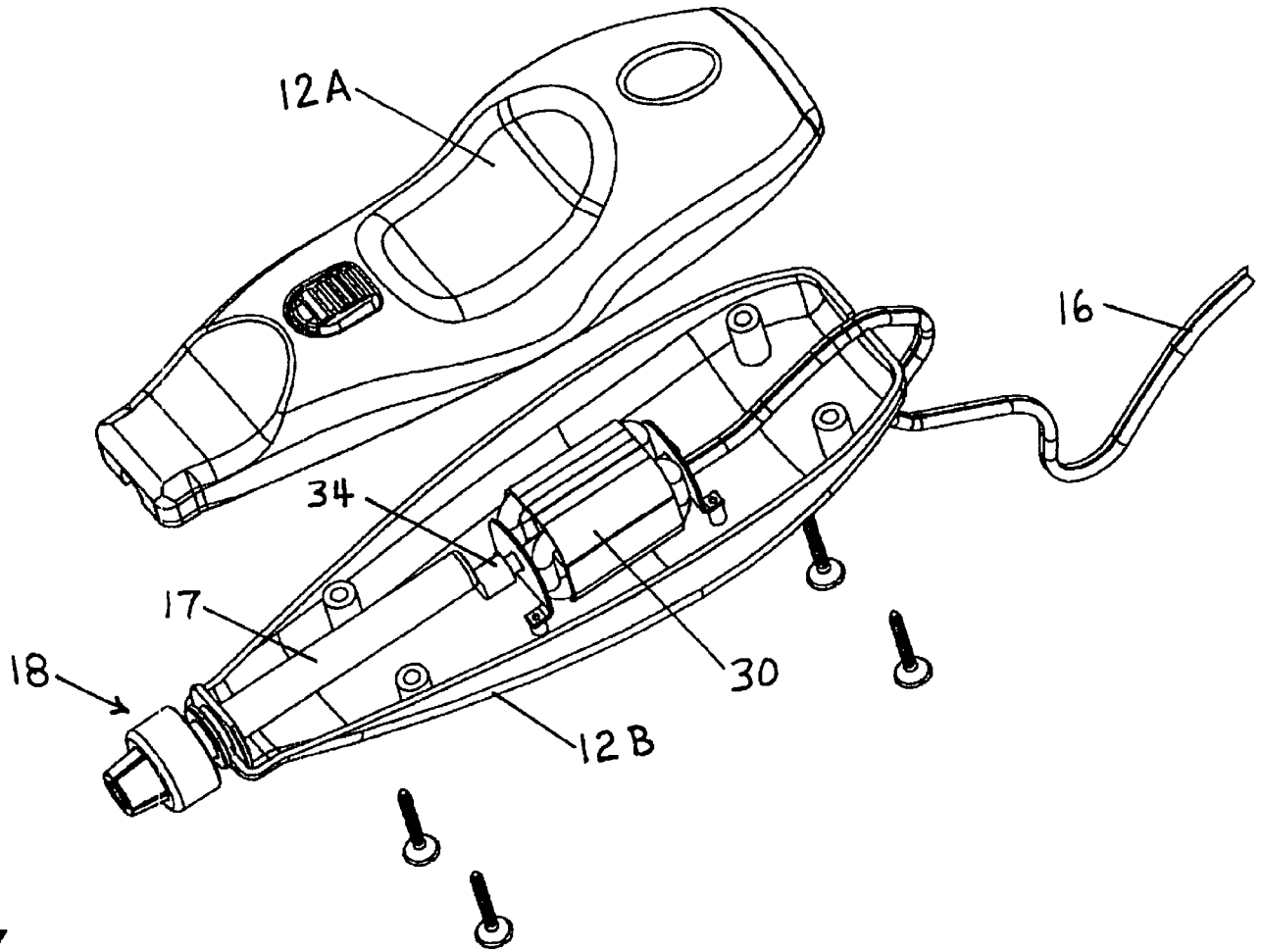
FIGS. 7–9 are exploded perspective views of the cutting utensil housing depicting internal components.
Figure 8:
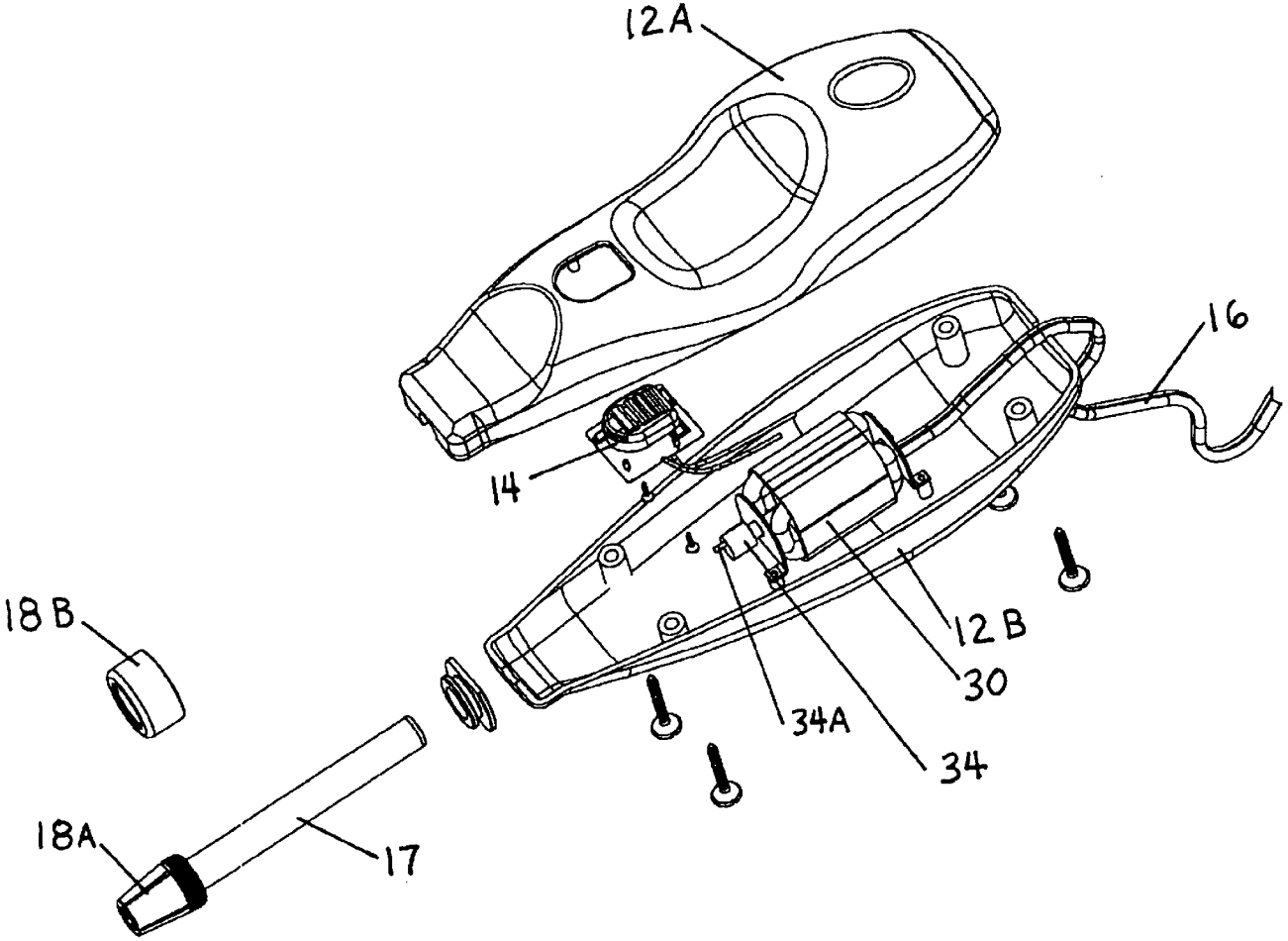
Figure 9:
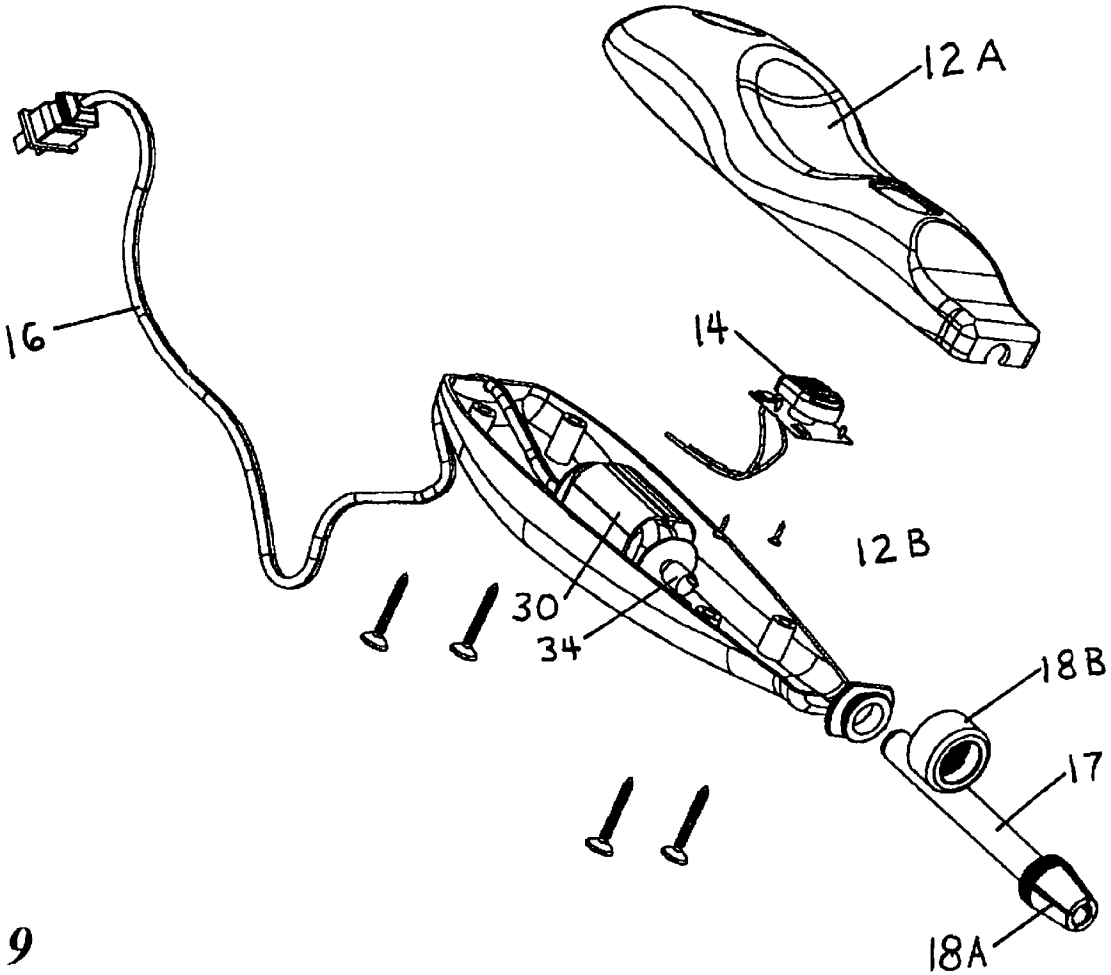

As best seen in FIGS. 7–9, housing 12 includes a pair of mating sections, referenced as 12A and 12B, which define an internal volume wherein an electric motor 30 is mounted. Motor 30 is preferably securely mounted within housing 12 by front and rear motor mounts 36A and 36B. Motor 30 is electrically connected to switch 14 to facilitate control thereof by the user. In an embodiment wherein motor 30 is powered by 120 VAC, motor 30 is electrically connected to power cord 16. In an embodiment wherein motor 30 is battery powered, motor 30 is connected to one or more batteries (not shown) mounted within housing 12.

Figure 13:
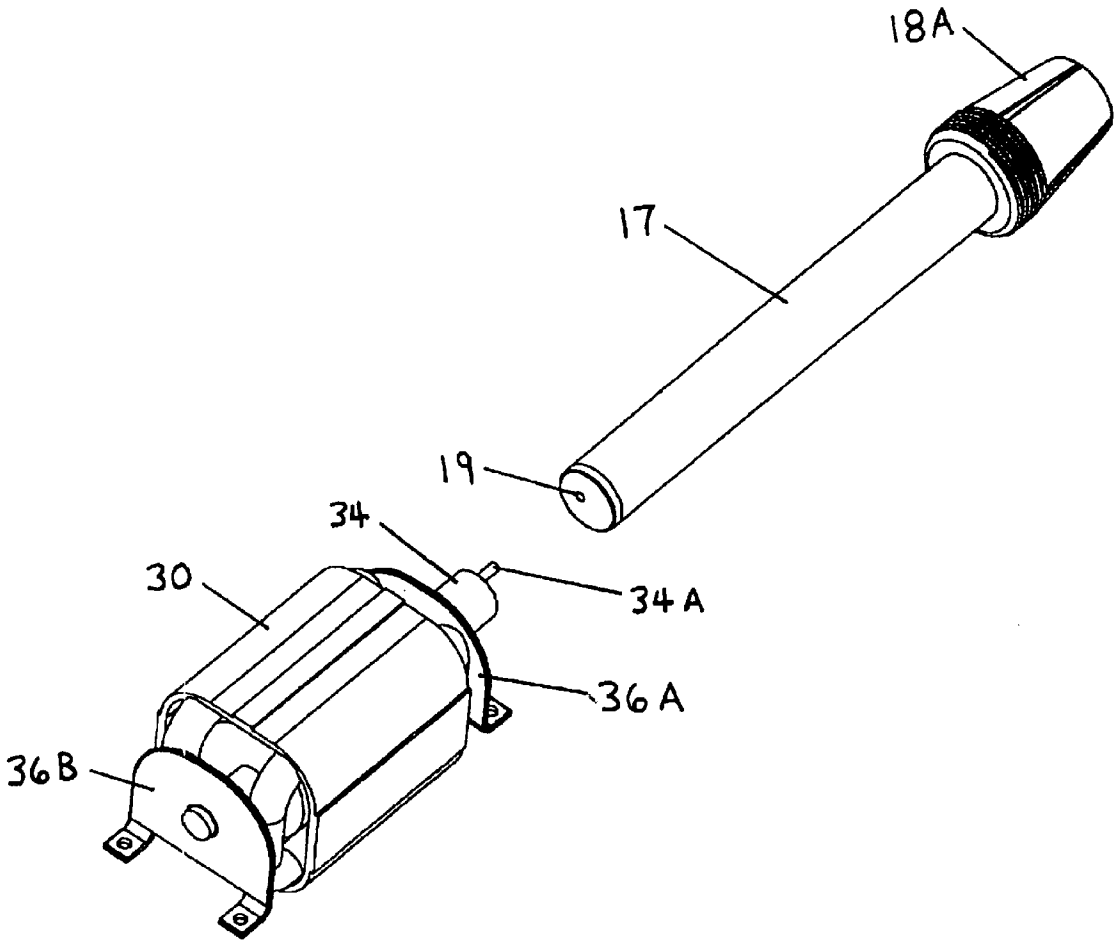
FIG. 13 is an exploded perspective view of the shaft and electric motor.
Figure 14:
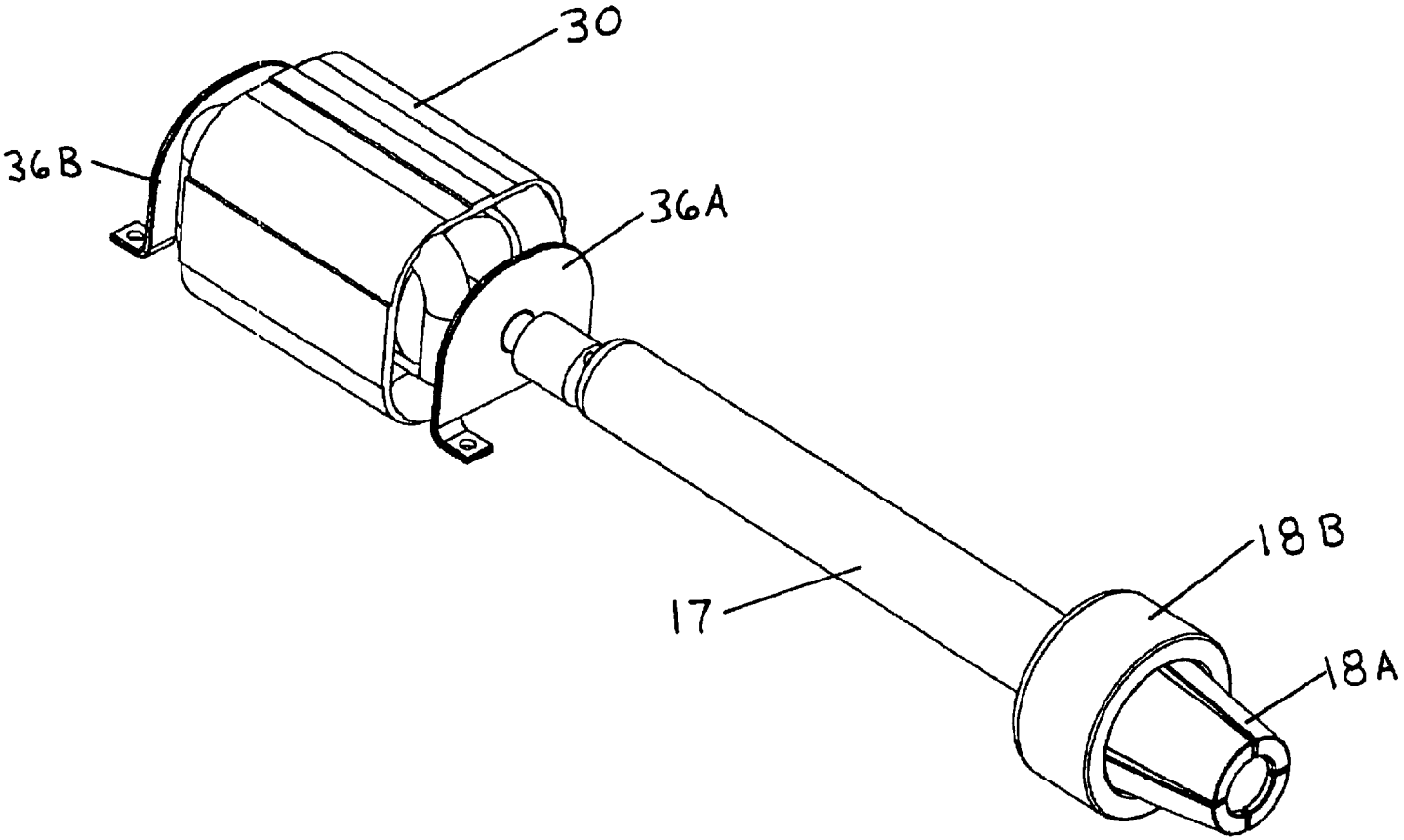
FIG. 14 is a perspective view thereof.

As best depicted in FIGS. 13 and 14, motor 30 has an output shaft connected to the end of shaft 17 by an oscillation generating coupling 34. In a preferred embodiment, coupling 34 includes an eccentrically connected projecting member 34A which is received in a recessed aperture 19 defined in the end of shaft 17 and thus translates rotation of the motor output shaft to shaft 17 so as to produce oscillating movement of shaft 17, tip 18, and connected attached cutting head 20.

Figure 15:
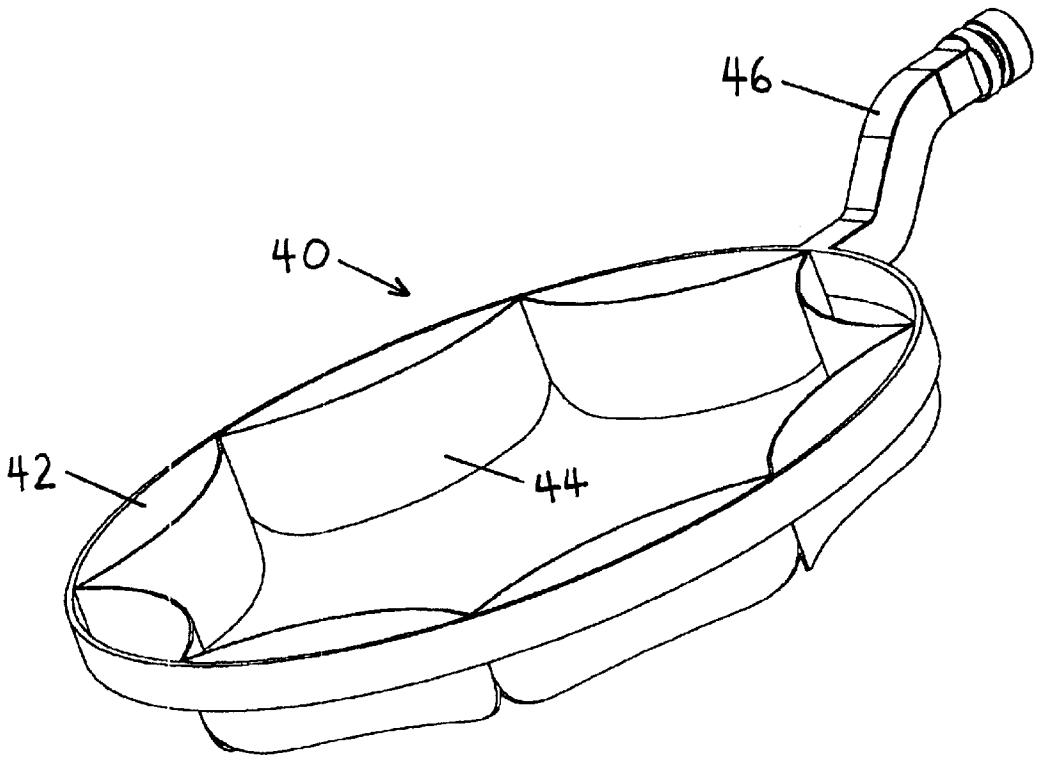
FIGS. 15–18 are perspective views of various cutting heads.
Figure 16:
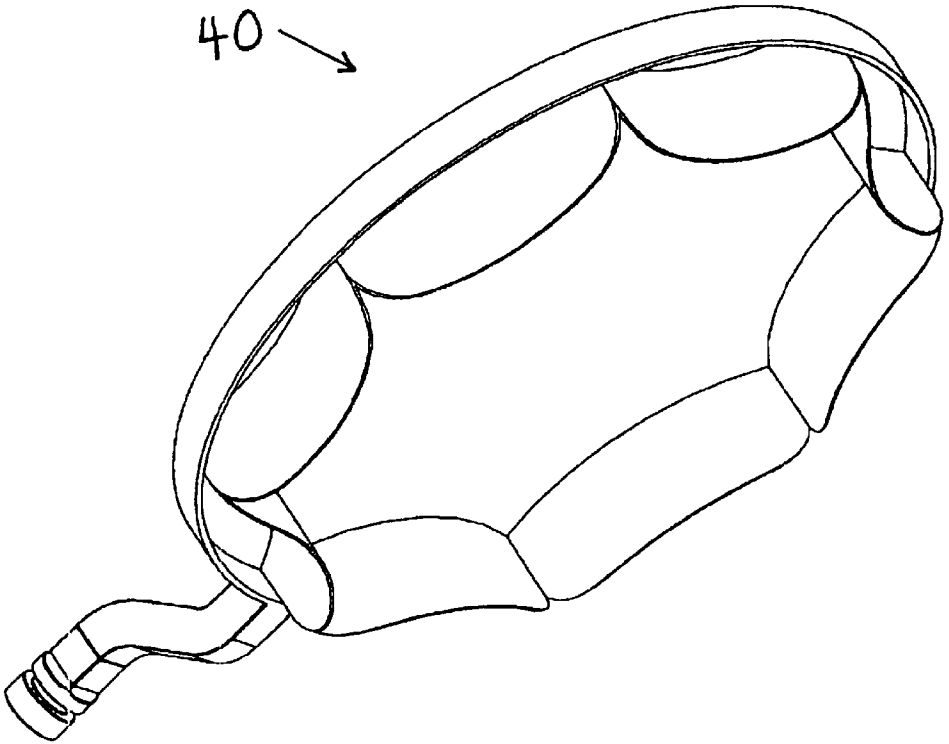
Figure 17:
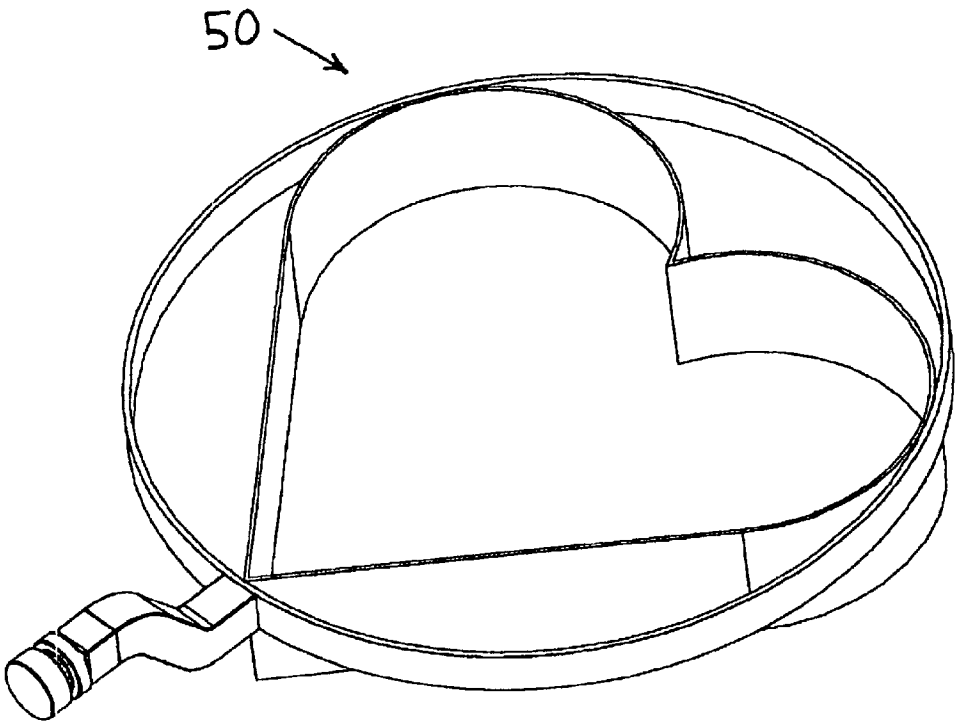
Figure 18:
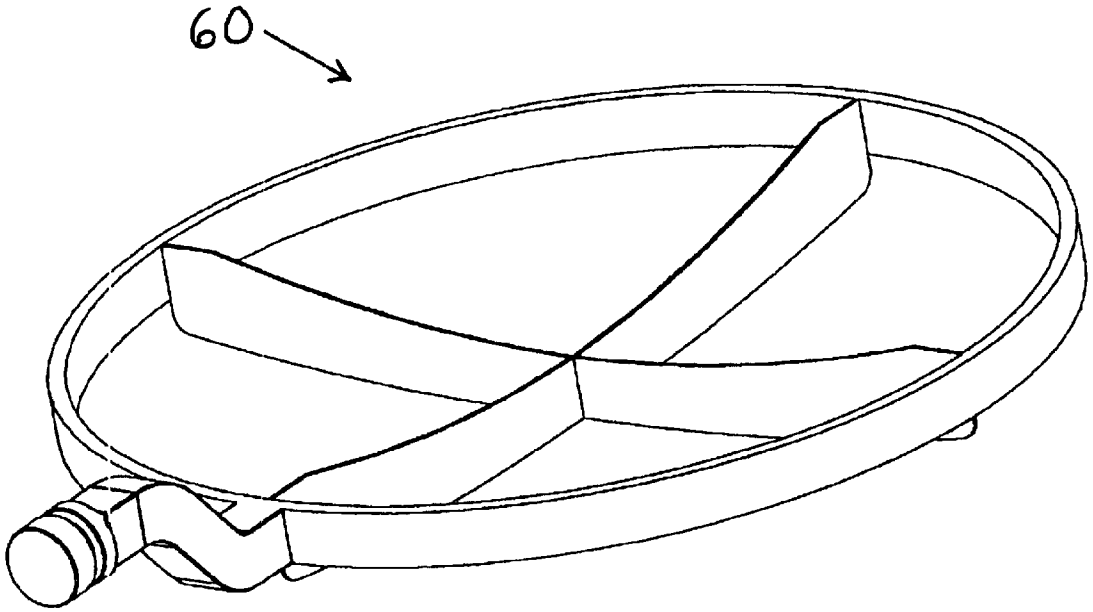
Figure 21:
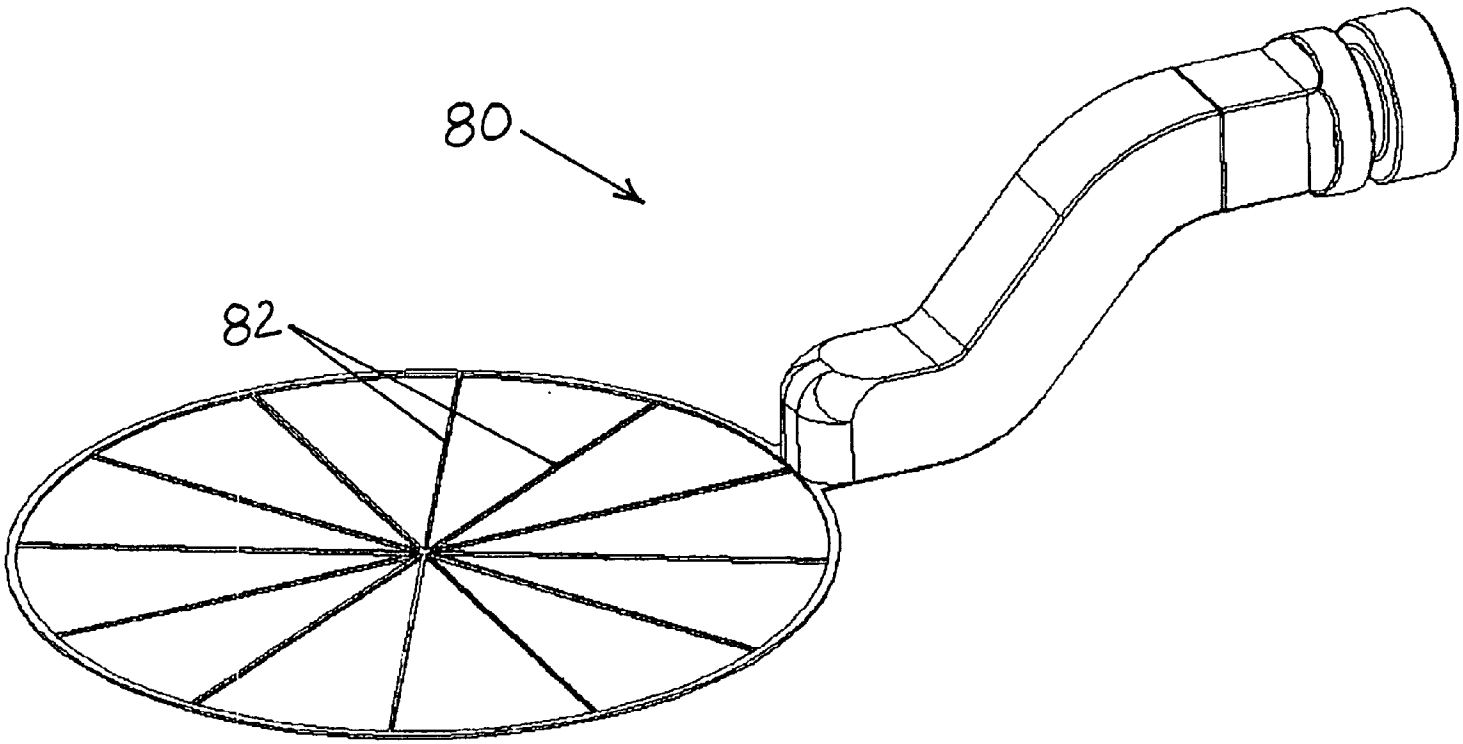
FIG. 21 is a perspective view of yet another cutting head having wire cutting elements.

FIGS. 15–18 illustrate various embodiments of cutting heads, referenced as 40, 50, and 60. Cutting head 40 includes an annular support ring 42, a shaped cutting member 44 connected to annular support ring 42, and a mounting stem 46 connected to annular support ring 42 and projecting radially outward therefrom. As noted herein above, support ring 42, cutting member 44, and stem 46, are preferably fabricated from stainless steel, however, any suitable material is considered within the scope of the present invention. In addition, annular support ring 42 provides a structural mount for supporting cutting member 44. Cutting member 44 includes a shaped, generally sharp, edge projecting from annular support ring 42 to facilitate cutting of the food product. Mounting stem 46 projects radially outward from support ring 42 and is preferably offset in a direction opposite of the sharp cutting edge of cutting member 44 to facilitate engagement of cutting member 44 with the food product when operatively attached to cutting utensil 10. The offset mounting stem structure is important to enable the user to properly position the cutting blade. As best seen in FIGS. 15 and 16, cutting head 40 defines a generally annular knife-like edge defining concave segments. As best depicted in FIG. 17, cutting head 50 defines a generally heart-shaped cutting edge. As best depicted in FIG. 18, cutting head 60 defines a generally X-shaped cutting edge. Finally, FIG. 21 depicts a further configuration cutting head, generally referenced as 80. Cutting head 80 includes a plurality of wire cutting members 82 that allow head 80 to easily slice through foods.

Figure 19:
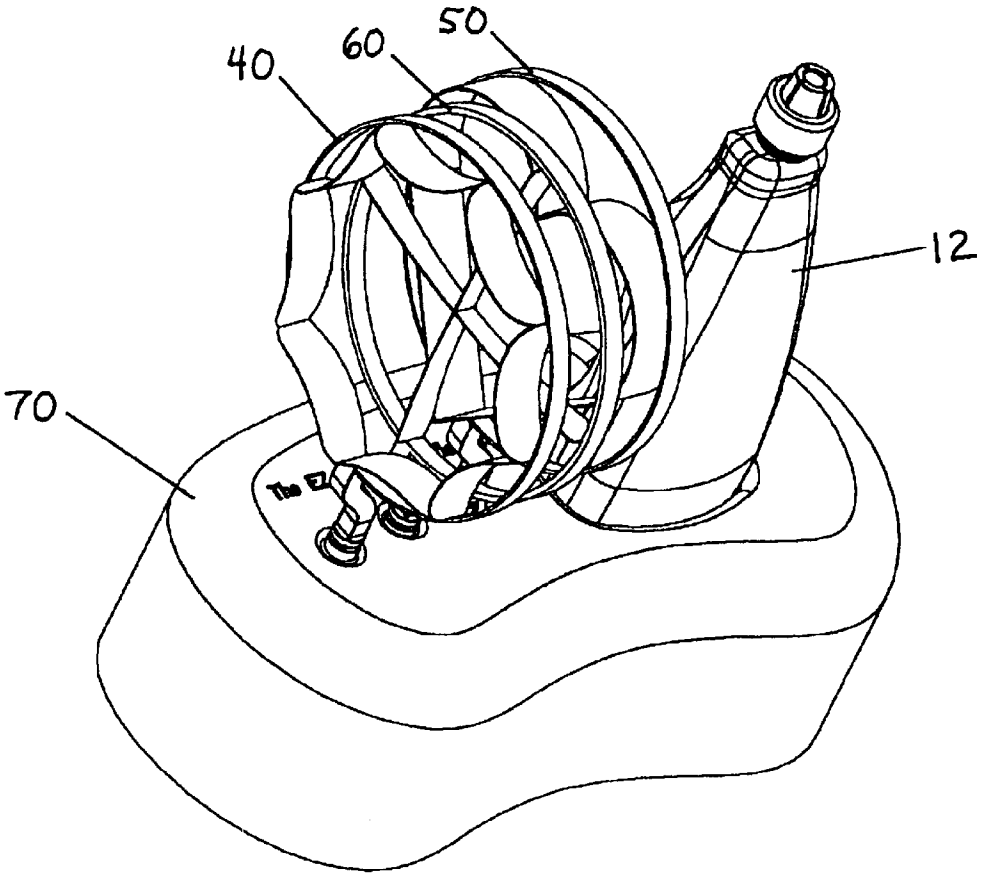
FIGS. 19–20 are perspective views of the cutting utensil and interchangeable heads stowed in a storage base.
Figure 20:
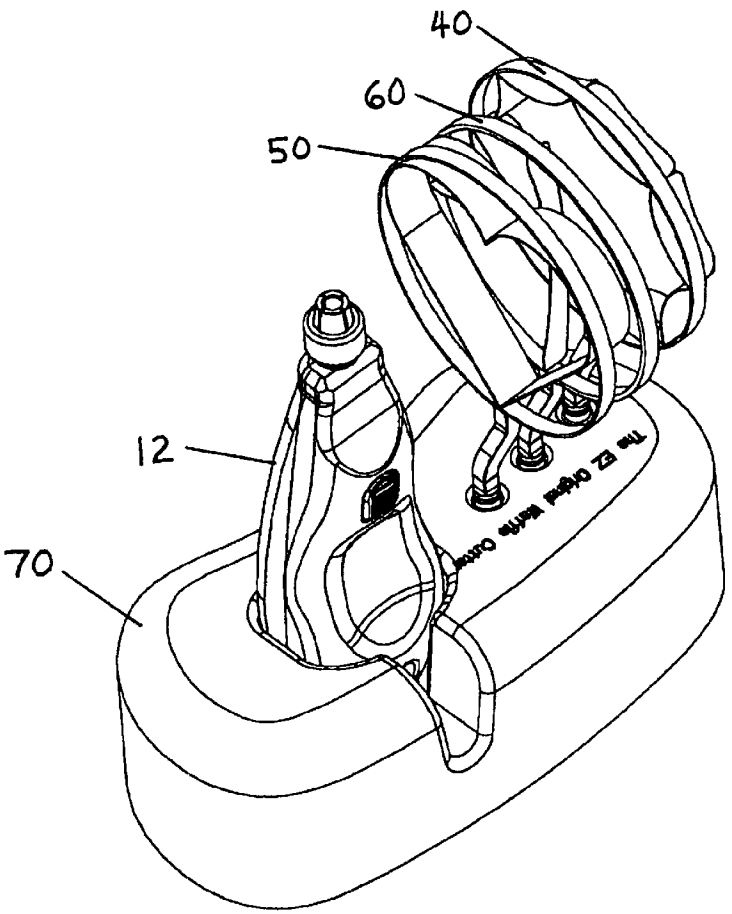

FIGS. 19 and 20 illustrate the improved cutting utensil of the present invention 10 and further discloses a storage base 70. Storage base 70 may simply provide a structure for organized countertop storage of the hand-held housing 12, and various attachable cutting heads 40, 50, and 60. In an embodiment wherein the device is battery powered, storage base 70 is preferably adapted to function as a charging stand to re-charge the batteries contained within housing 12.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. An electric cutting utensil adapted for cutting foods into fanciful shapes, said cutting utensil comprising:

a housing;

an electric motor contained within said housing;

means for selectively providing electrical power to said electric motor;

a shaft having a first end connected to said electric motor via a coupling;

said coupling including means for causing said shaft first end to oscillate radially upon activation of said motor;

said shaft having a second end projecting from said housing, said second end adapted for attachment of a cutting head;

said cutting head including a mounting stem, and a generally sharp projecting cookie-cutter type edge connected to said mounting stem, said mounting stem sized for attachment to said shaft second end;

whereby activation of said motor causes oscillation of said shaft and said attached cutting head.

2. An electric cutting utensil according to claim 1, wherein said generally sharp projecting cookie cutter type edge defines a two dimensional shape.

3. An electric cutting utensil according to claim 2, wherein said two dimensional shape is a fanciful shape.

4. An electric cutting utensil adapted for cutting foods into fanciful shapes, said cutting utensil comprising:

a hand-held housing;

an electric motor contained within said housing;

means for selectively providing electrical power to said electric motor;

an elongate shaft partially disposed within said housing, said shaft having a first end connected to said electric motor via a mechanical coupling and a second end;

said mechanical coupling including means for causing said shaft first end to move along a generally circular path upon activation of said motor;

said shaft second end projecting from said housing, said second end adapted with means for attaching a cutting head thereto;

at least one cutting head including a mounting stem sized for attachment to said shaft second end by connection to said means for attaching, and a generally sharp projecting cookie cutter shaped edge for cutting foods into uniform fanciful shapes;

whereby activation of said motor causes oscillation of said shaft and said attached cutting head.

5. An electric cutting utensil according to claim 4, wherein said means for attaching is a chuck lock.

6. An electric cutting utensil according to claim 4, further including a base adapted to receive said hand-held apparatus.

7. An electric cutting utensil according to claim 4, wherein said means for selectively providing electrical power to said electric motor includes a battery contained within said housing.

8. An electric cutting utensil according to claim 4, wherein said means for selectively providing electrical power to said electric motor includes a power cord.

9. An electric utensil according to claim 4, wherein means for causing said shaft to oscillate upon activation of said motor includes an eccentrically disposed projecting arm connected to said shaft and said coupling.

10. An electric utensil according to claim 4, wherein said cutting head mounting stem comprises an elongate stem having a first and second generally parallel sections connected by an angularly disposed section.

* * * * *